US006662415B1

(12) United States Patent
Lin

(10) Patent No.: US 6,662,415 B1
(45) Date of Patent: Dec. 16, 2003

(54) FASTENER FOR LACE

(76) Inventor: Wen-Chi Lin, No. 1, Alley 16, Lane 171, Nan Lei Road, Chen Ping Li, Ho Mei Town, Chang Hua Hsien (TW)

( * ) Notice: Subject to any disclaimer, the term of this patent is extended or adjusted under 35 U.S.C. 154(b) by 0 days.

(21) Appl. No.: 10/385,952

(22) Filed: Mar. 10, 2003

(51) Int. Cl.[7] ..... A43C 7/00; A43B 11/00; F15G 11/00

(52) U.S. Cl. ..... 24/712.9; 24/712.1; 24/712.2; 24/713.3; 24/713.6; 24/129 R; 36/50.1

(58) Field of Search ..... 24/712.9, 712.1, 24/712, 712.2, 713.2, 713.3, 713.4, 713.6, 714.6, 129 R, 129 A, 131 C; 36/50.1

(56) References Cited

U.S. PATENT DOCUMENTS 969,054 A * 8/1910 Hammalian ..... 24/712.9
4,872,240 A * 10/1989 Spinner et al. ..... 24/129 R
5,182,838 A * 2/1993 Stenner ..... 24/712.1
5,572,778 A * 11/1996 Stenner et al. ..... 24/712.9
6,003,214 A * 12/1999 Lee ..... 24/712.2
6,167,598 B1 * 1/2001 Pransky et al. ..... 24/712.9
6,334,240 B1 * 1/2002 Li ..... 24/712.1
6,381,816 B1 * 5/2002 Lai et al. ..... 24/712.1
6,560,903 B1 * 5/2003 Darley ..... 24/712.2

* cited by examiner

*Primary Examiner*—Victor Sakran
(74) *Attorney, Agent, or Firm*—Alan D. Kamrath; Rider Bennett LLP

(57) ABSTRACT

A fastener for lace includes an upper plate, a lower plate and first, second, third and fourth rods extending between the upper and lower plates. The upper and lower plates both include a front edge, a rear edge, a first lateral edge and a second lateral edge. The first and second rods extend between the first lateral edge of the upper plate and the first lateral edge of the lower plate. The third and fourth rods extend between the second lateral edge of the upper plate and the second lateral edge of the lower plate. A first length of lace is wound about the first rod and directed past the second rod. A second length of lace is wound about the third rod and directed past the fourth rod.

6 Claims, 11 Drawing Sheets

FASTENER FOR LACE

BACKGROUND OF THE INVENTION

1. Field of Invention

The present invention relates to a fastener for a lace, string, rope or the like.

2. Related Prior Art

Referring to FIG. 11, a conventional fastener for laces, strings and ropes is shown. This conventional fastener includes a housing 2, a spring 4 and a control element including a button 3 and a rod 6 extending from the button 3. The housing 2 defines two holes 7. The spring 4 is put in the housing 2. The button 3 is located outside the housing 2. The rod 6 defines a hole 8. The rod 6 is inserted in the housing 2 and is biased by means of the spring 4. In use, the rod 6 is pushed down via pressing the button 3 so that the axis of the holes 7 is aligned with the axis of the hole 8. Two sections of a lace, string, rope or the like 5 are inserted through the holes 7 and 8. Then, the push button 3 is released so that the sections of the lace, string, rope or the like 5 are fastened by means of the rod 6 and the housing 2. However, when the sprig 4 is new, it exerts an inadequate force for fastening the sections of the lace, string, rope or the like 5, and this problem is even worse after it is used for some time. Furthermore, the button 3 can be unintentionally pushed, thus loosening the lace, spring, rope or the like 5.

The present invention is therefore intended to obviate or at least alleviate the problems encountered in the prior art.

SUMMARY OF THE INVENTION

It is the primary object of the present invention to provide an easy-to-use and secure fastener for lace.

According to the present invention, a fastener for lace includes an upper plate, a lower plate and fist second, third and fourth rods extending between the upper and lower plates. The upper and lower plates both include a front edge, a rear edge, a first lateral edge and a second lateral edge. The first and second rods extend between the first lateral edge of the upper plate and the first lateral edge of the lower plate. The third and fourth rods extend between the second lateral edge of the upper plate and the second lateral edge of the lower plate. A first length of lace is wound about the first rod and directed past the second rod. A second length of lace is wound about the third rod and directed past the fourth rod.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein:

FIG. 11 is a cross-sectional view of a conventional fastener for a lace, string, rope or the like.

DETAILED DESCRIPTION OF PREFERRED EMBODIMENT

Figure 1:
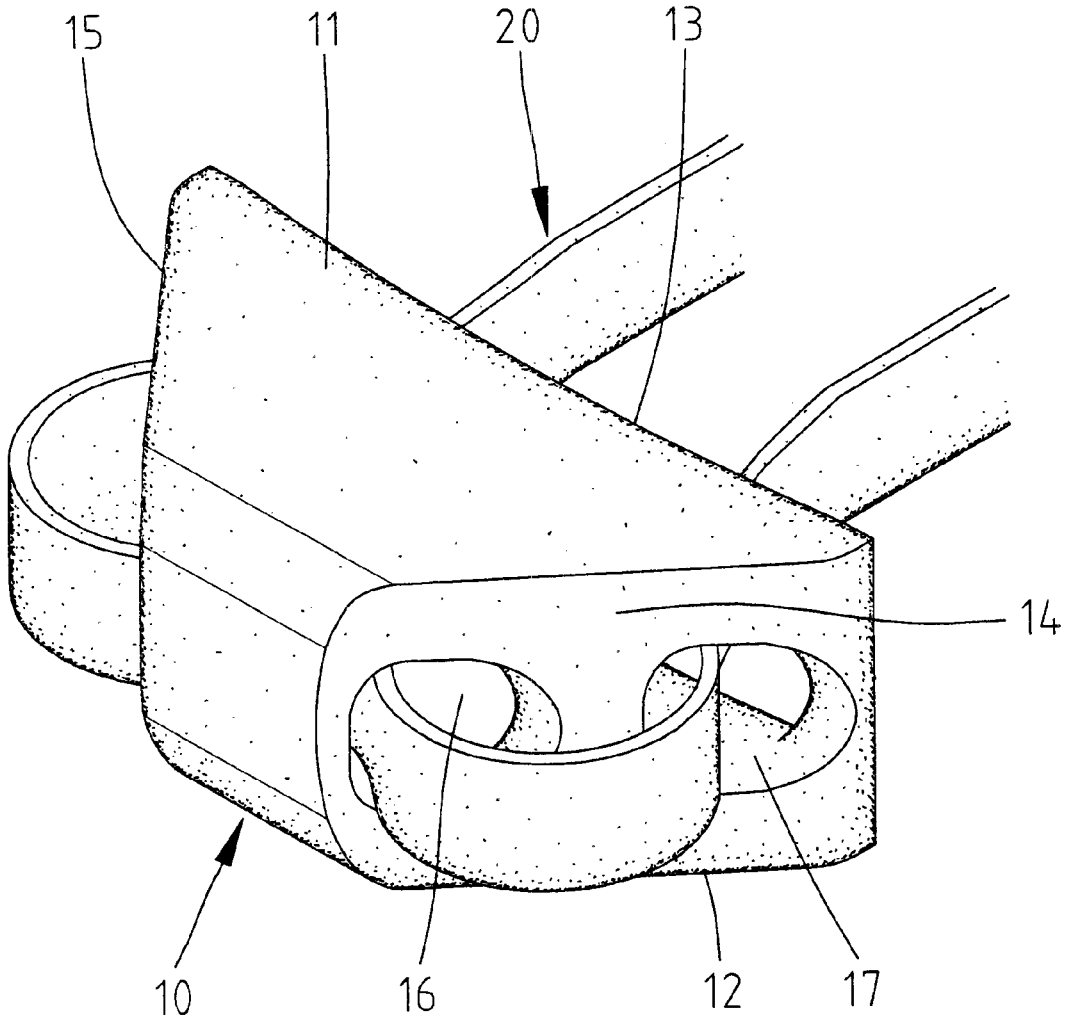
FIG. 1 is a perspective view of a fastener according to a first embodiment of the present invention.
Figure 2:
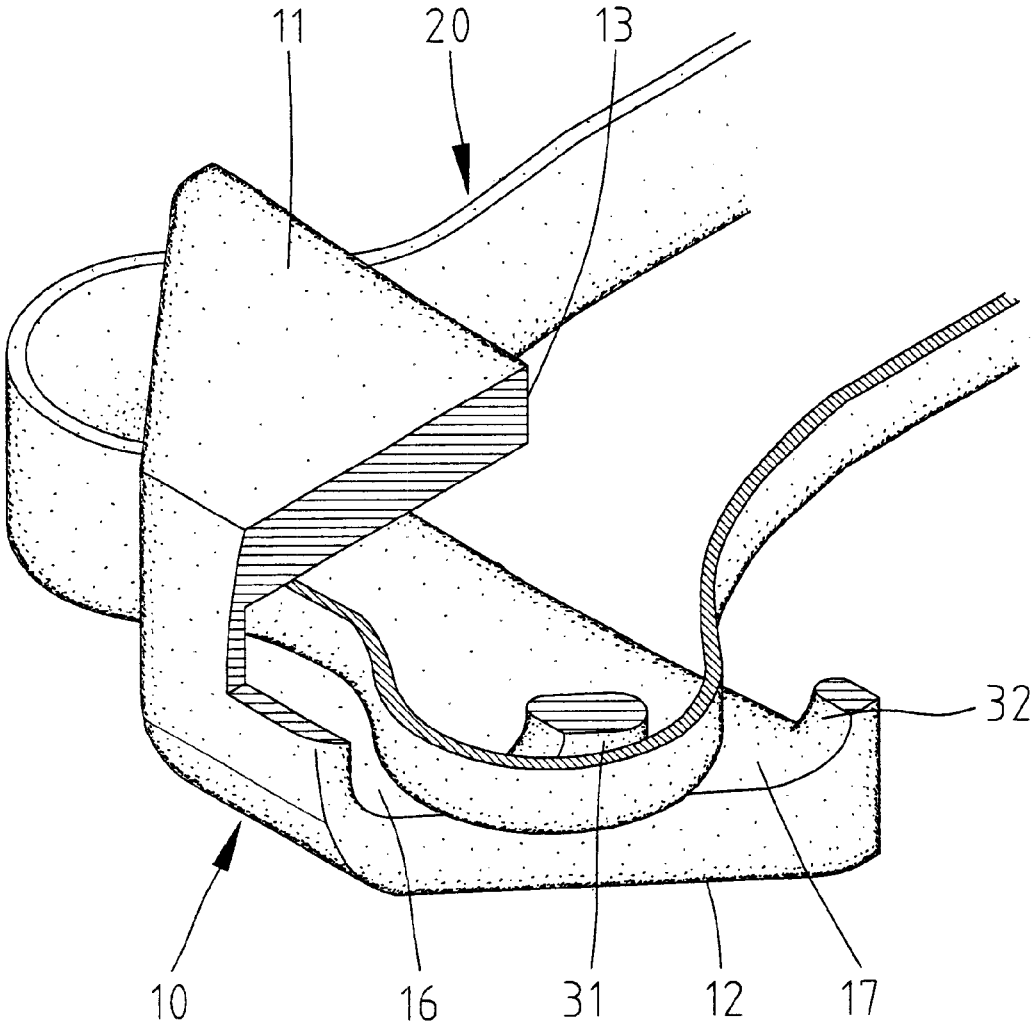
FIG. 2 is a cutaway view of the fastener shown in FIG. 1.
Figure 3:
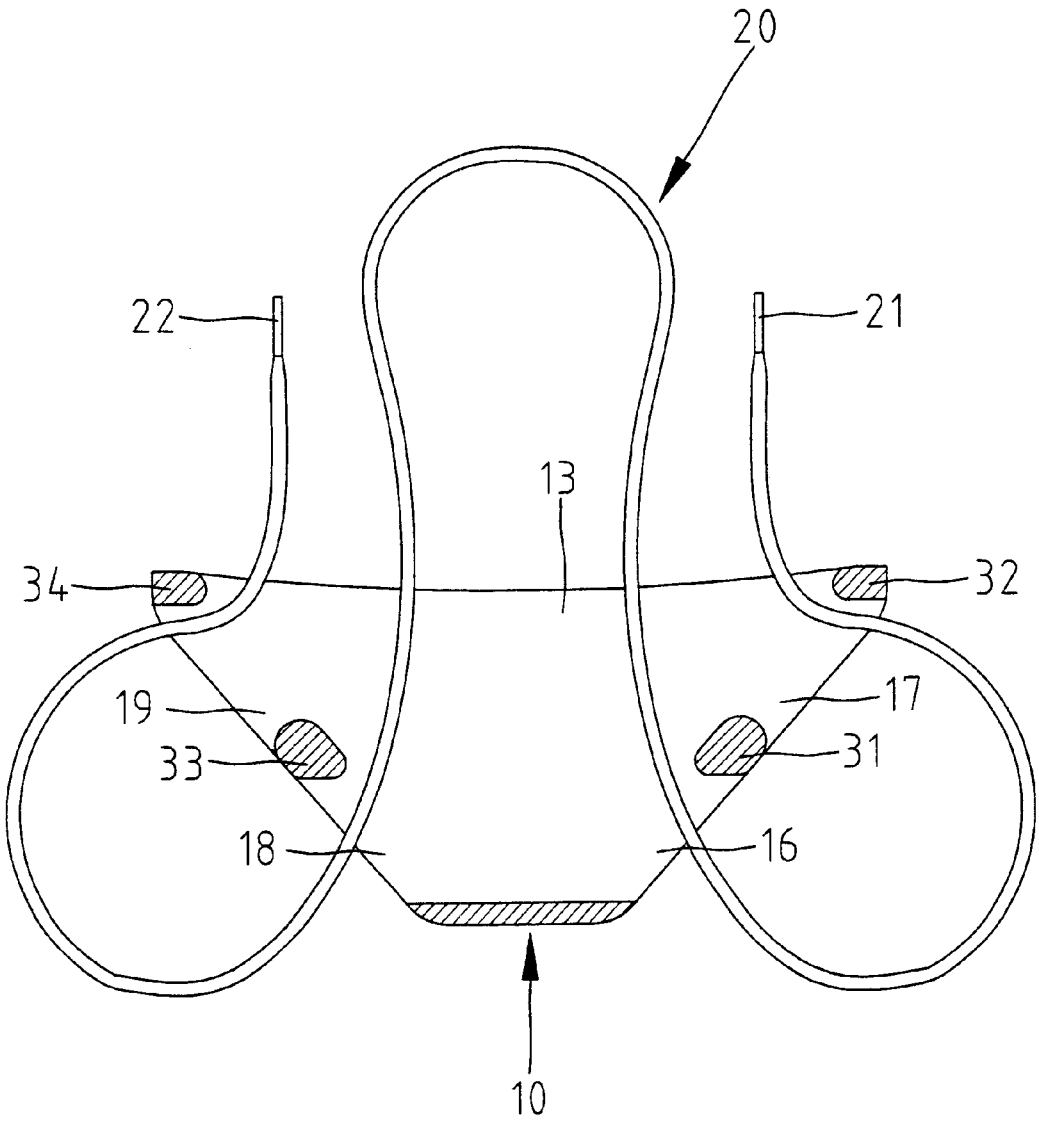
FIGS. 3–5 are cross-sectional views of the fastener shown in FIG. 1.

Referring to FIGS. 1–3, according to the preferred embodiment of the present invention, a fastener 10 is a hollow element through which a lace, string, rope or the like, hereinafter referred to as lace 20, can be inserted.

The fastener 10 includes an upper plate 11, a lower plate 12, a front portion (not numbered), a first lateral portion 14 and a second lateral portion 15. The upper plate 11 and the lower plate 12 are both shaped as an equilateral trapezoid (or "trapezium" as used in the UK) with a first lateral edge, a second lateral edge as long as the first lateral edge, a front edge and a rear edge longer than the font edge. The first lateral portion 14 extends between the first lateral ed of the upper plate 11 and the first lateral edge of the lower plate 12. The second lateral portion 15 extends between the second lateral edge of the upper plate 11 and tile second lateral edge of the lower plate 12. The first lateral portion 14 defines two holes 16 and 17, thus forming a first rod 31 between the holes 16 and 17 and a second rod 32 beside the hole 17. The second lateral portion 15 defines two holes 18 and 19, thus forming a third rod 33 between the holes 18 and 19 and a fourth rod 34 beside tie hole 19. A space 13 is defined between the second and fourth rods 32 and 34.

Referring to FIG. 3, the lace 20 includes a first end 21, a second end 22 and a middle section 23 between the first end 21 and the second end 22. The first end 21 of the lace 20 is inserted through the holes 16 and 17. That is, the first end 21 of the lace 20 is wound about the first rod 31 and directed past the second rod 32. The second end 22 of the lace 20 is inserted through the holes 18 and 19. That is, the second end 22 of the lace 20 is wound about the third rod 33 and directed past the fourth rod 34.

Figure 4:
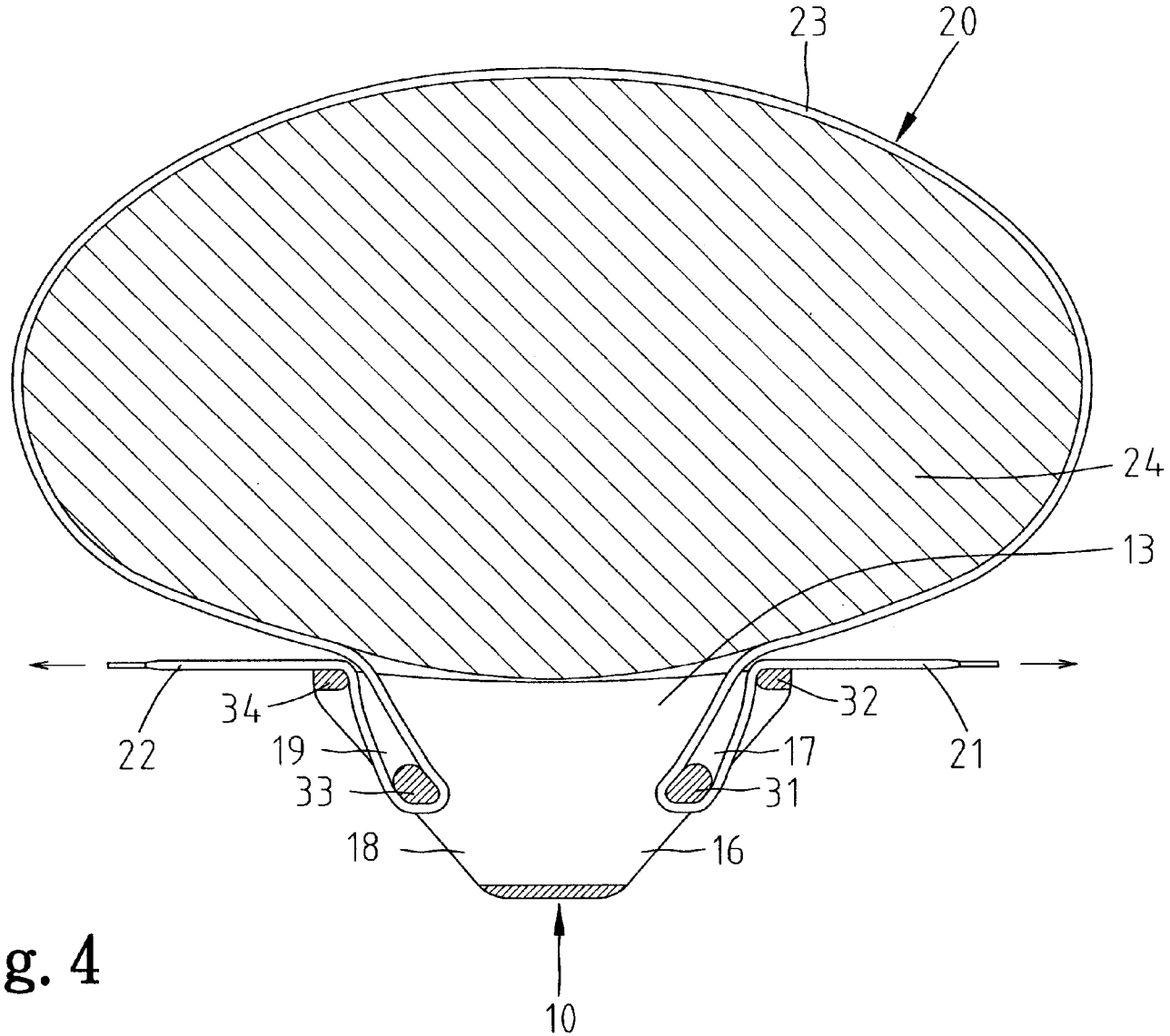

Referring to FIG. 4, an article 24 is shown. The middle section 23 of the lace 20 is wound around the article 24. The first end 21 and the second end 22 of the lace 20 are pulled from each other, as indicated by means of two arrows. Thus, the article 24 is tightly wrapped via the middle section 23 of the lace 20.

Figure 5:
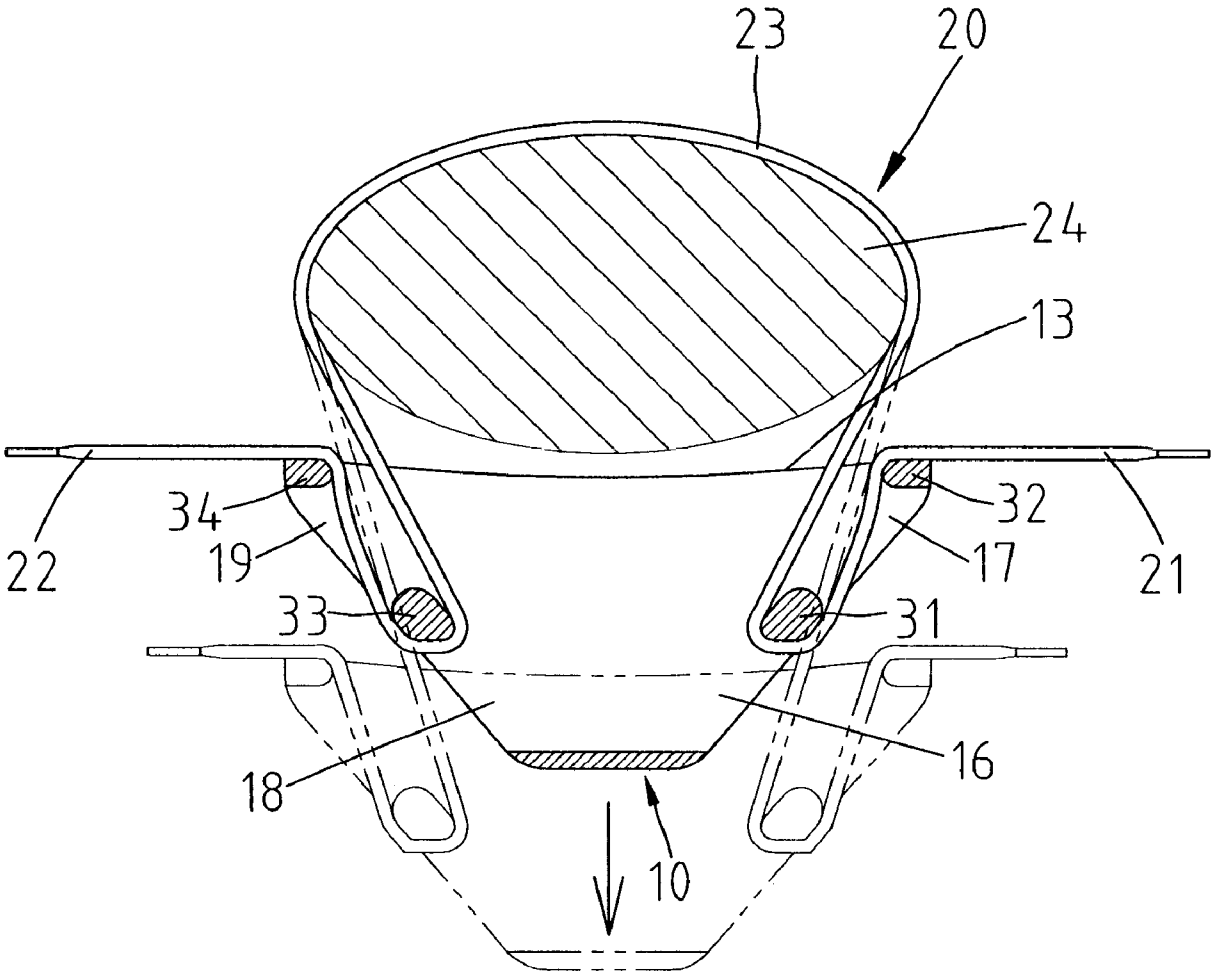

Referring to FIG. 5, the fastener 10 is pulled from the article 24, thus removing the first end 21 of the lace 20 from another section of the lace 20, and the second end 22 of the lace 20 from still another section of the lace 20. Thus, the fastener 10 can be removed from the lace 20.

Figure 6:
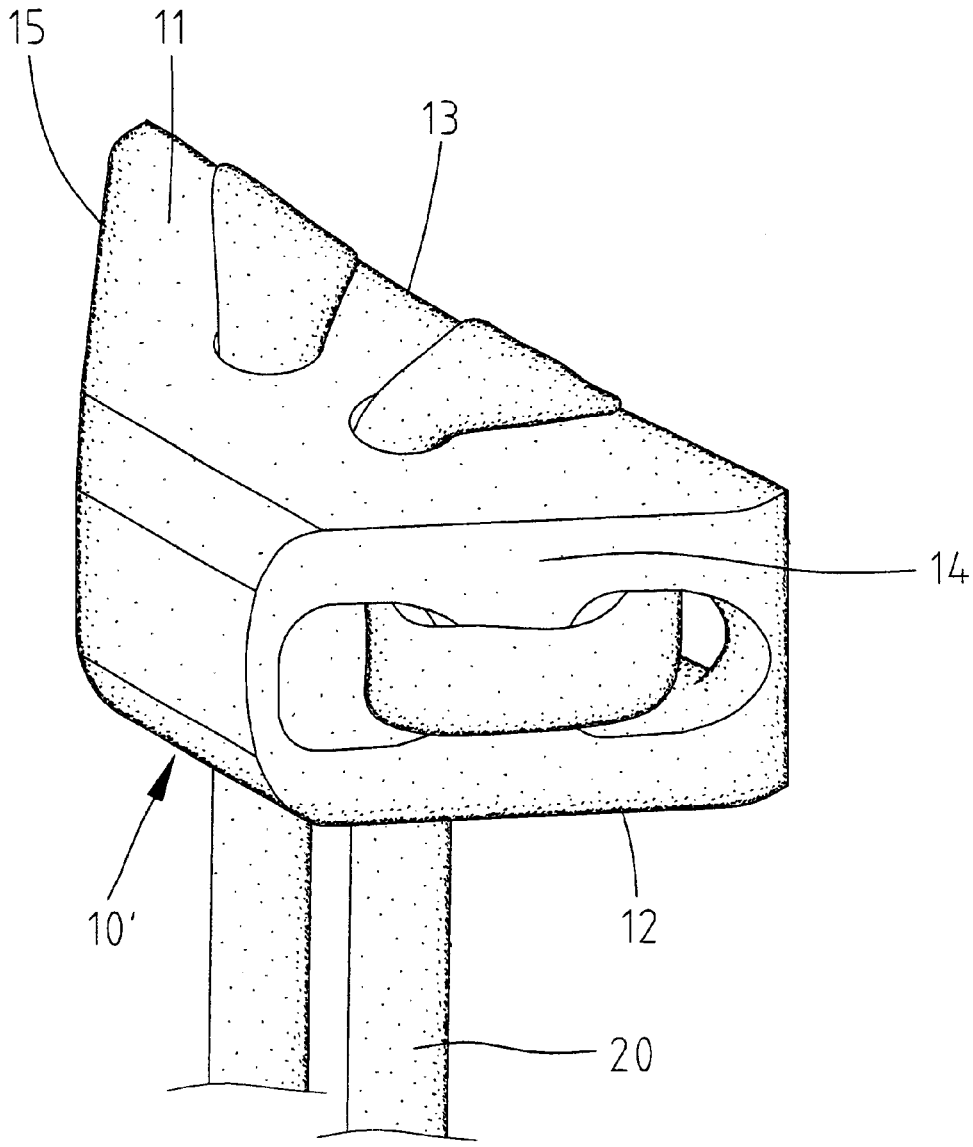
FIG. 6 is a perspective view of a fastener according to a second embodiment of the present invention.

Referring to FIG. 6, a fastener 10' according to a second embodiment of the present invention is shown. The second embodiment is different from the first embodiment in that the upper plate 11 defines a first hole and a second hole and in that the lower plate 12 defines first hole and a second hole. After insertion through the space 13, the first end 21 of the lace 20 is inserted through the first hole of the upper plate 11 into the first hole of the lower plate 12. After inserting through the space 13, the second end 22 of the lace 20 is inserted through the second hole of the upper plate 11 into the second hole of the lower plate 12.

Figure 7:
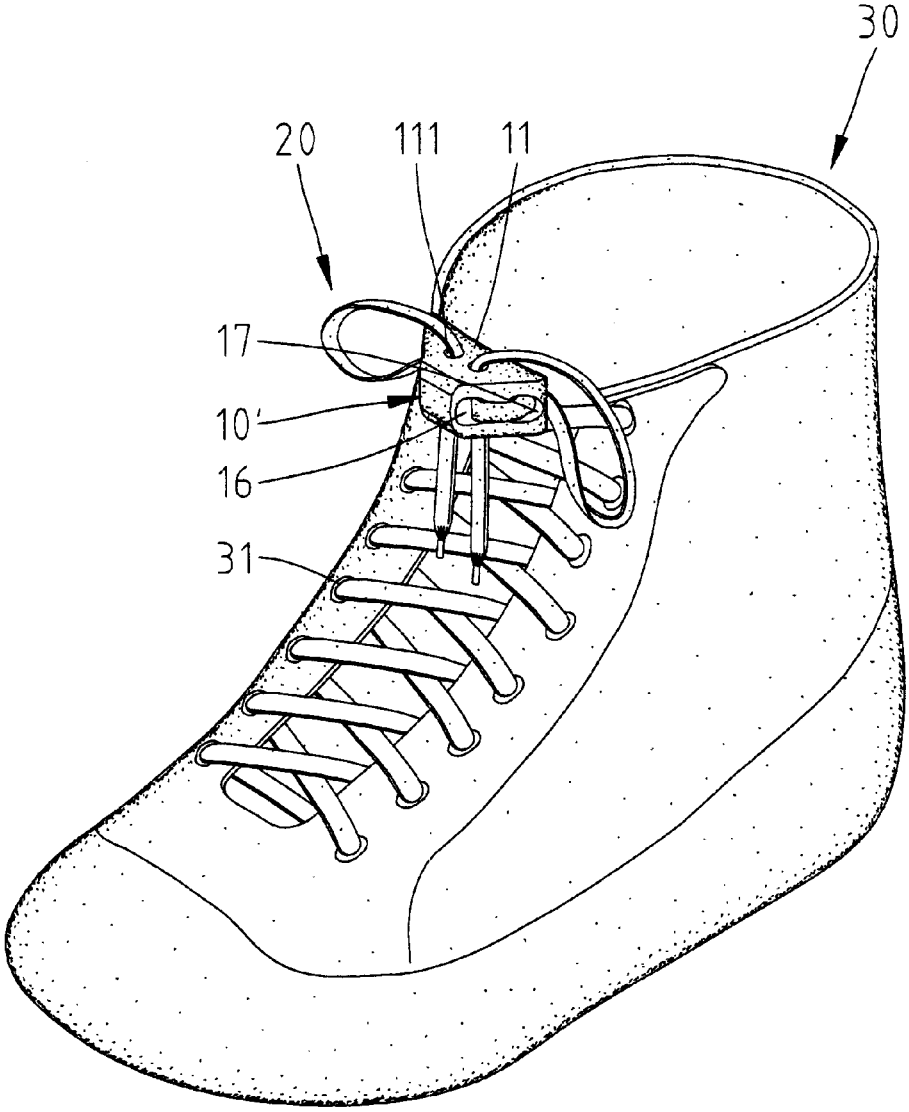
FIG. 7 is a perspective view of a basketball shoe with a shoelace fastened utilizing the fastener shown in FIG. 6.
Figure 8:
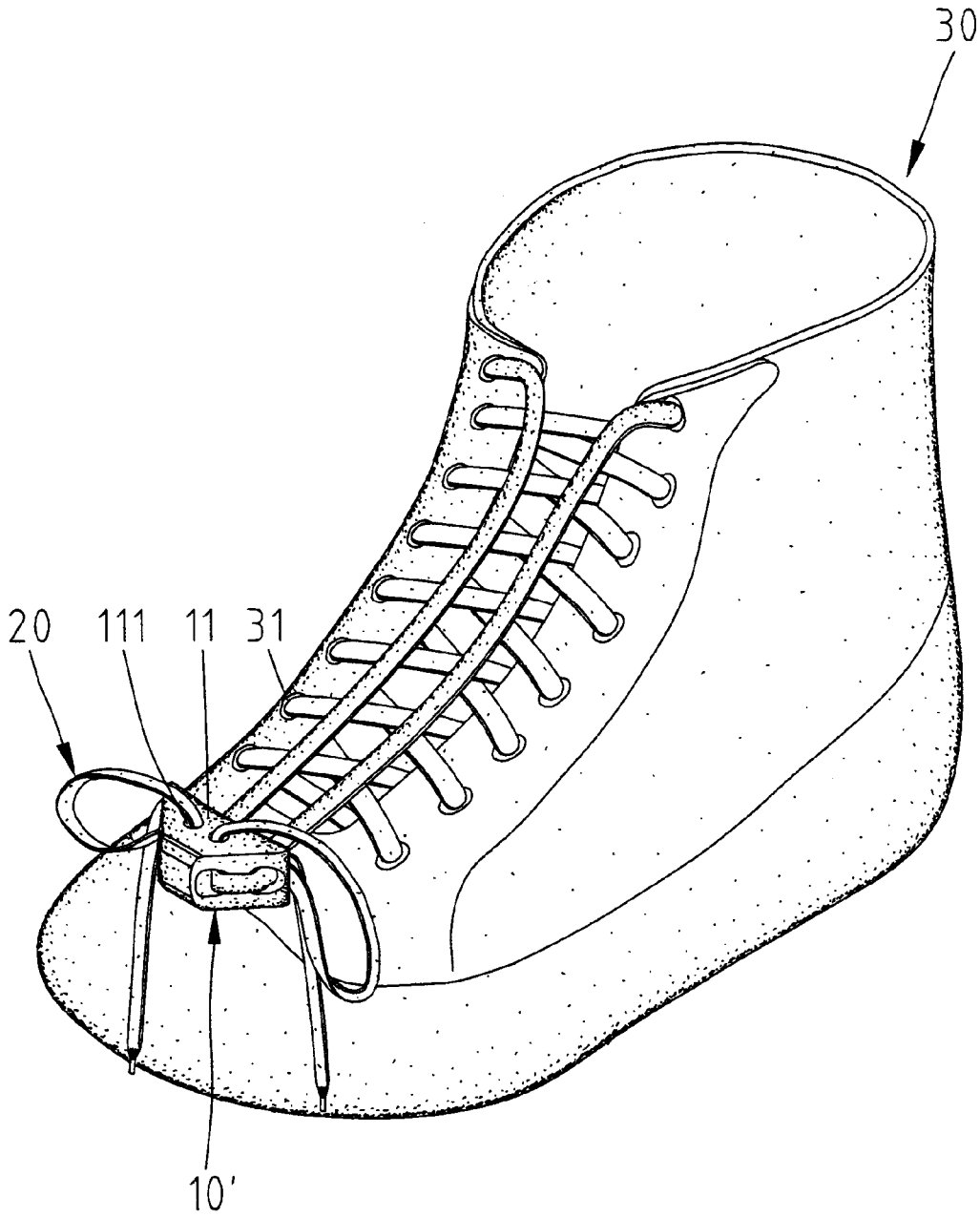
FIG. 8 is similar to FIG. 7, but showing the shoelace wound on the basket shoe in a different manner.
Figure 9:
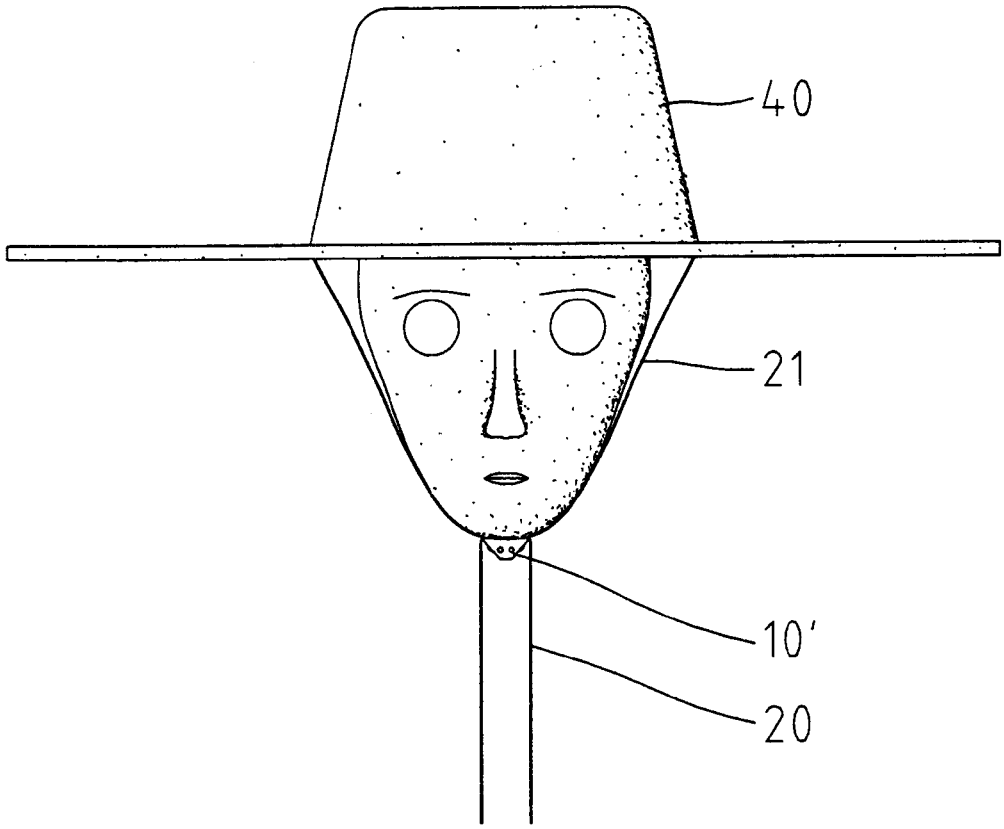
FIG. 9 is a front view of a hat with two strings fastened utilizing the fastener shown in FIG. 6.

FIG. 7 shows the lace 20 used as a shoelace of a basketball shoe 30. The lace 20 is fastened via the fastener 10' shown in FIG. 6. FIG. 8 is similar to FIG. 7, but showing the lace 20 wound on the basketball shoe 30 in a different manner FIG. 9 shows a hat 40 with two hat strings 210 fastened by means of the fastener 10' shown in FIG. 6.

Figure 10:
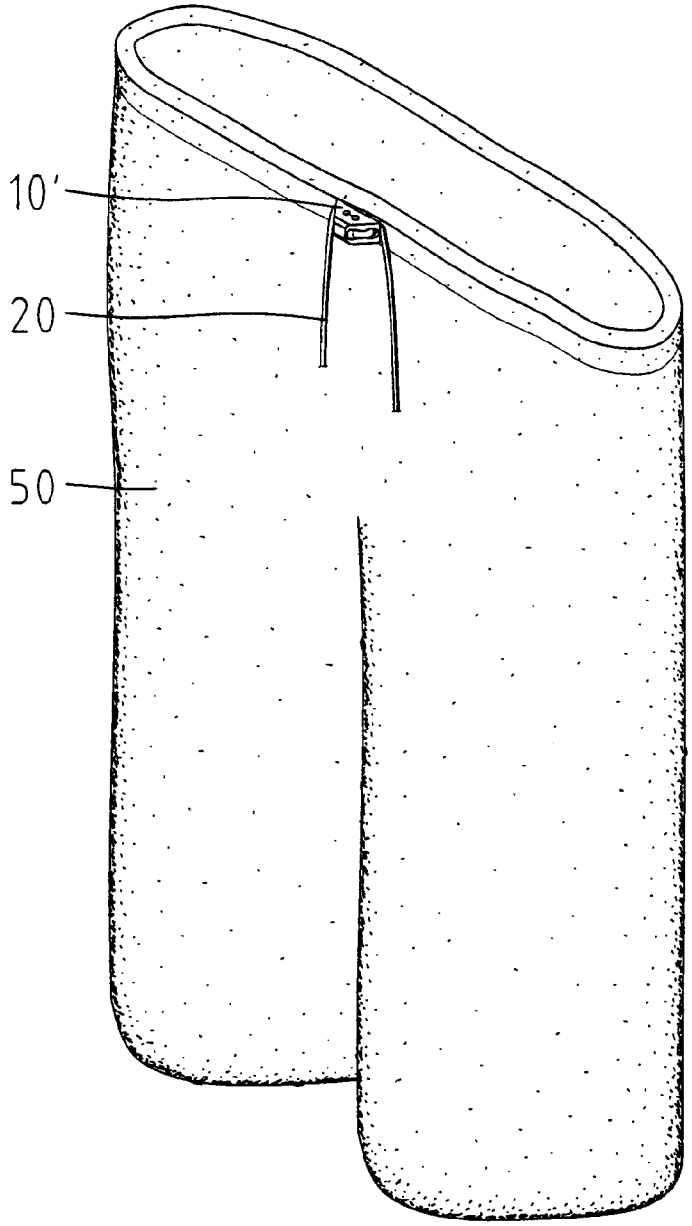
FIG. 10 is a perspective view of a pair of trousers with a string fastened utilizing the fastener shown in FIG. 6.
Figure 11:
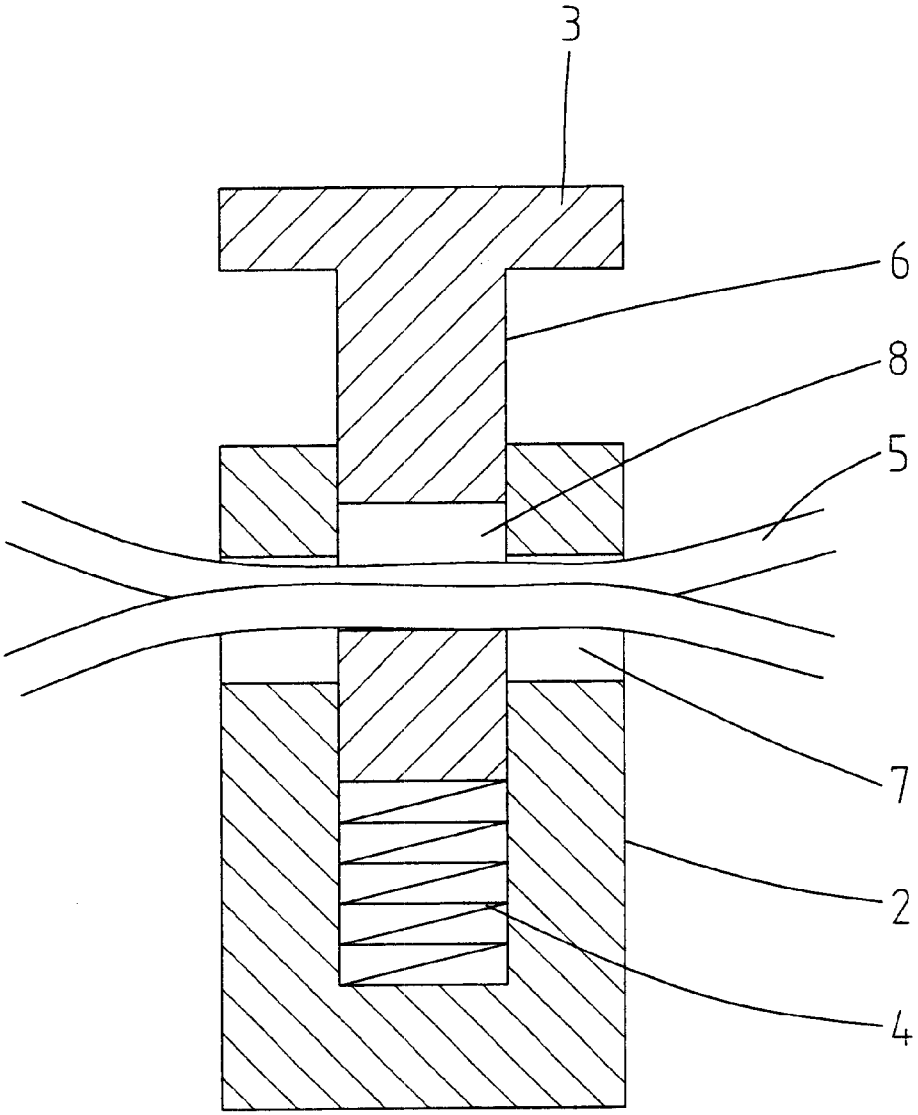
Fig. 11 PRIOR ART

FIG. 10 shows the lace 20 for use as a trousers belt of a pair of trousers 50. The lace 20 is fastened by means of the fastener 10' shown in FIG. 6.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A fastener for lace including:

an upper plate with a front edge, a rear edge, a first lateral edge and a second lateral edge;

a lower plate with a front edge, a rear edge, a first lateral edge and a second lateral edge;

a first rod extending between the first lateral edge of the upper plate and the first lateral edge of the lower plate;

a second rod extending between the first lateral edge of the upper plate and the first lateral edge of the lower plate;

a third rod extending between the second lateral edge of the upper plate and the second lateral edge of the lower plate; and a fourth rod extending between the second lateral edge of the upper plate and the second lateral edge of the lower plate, wherein a first length of lace is wound about the first rod and directed past the second rod, and a second length of lace is wound about the third rod and directed past the fourth rod, wherein the upper plate defines a first hole for receiving the first length of lace and a second hole for receiving the second length of lace, and the lower plate defines a first hole for receiving the first length of lace and a second hole for receiving the second length of lace.

2. The fastener according to claim 1 wherein the upper plate and the lower plate are both shaped as a trapezoid.

3. The fastener according to claim 2 wherein the upper plate and the lower plate are both shaped as an equilateral trapezoid.

4. The fastener according to claim 1 wherein the fastener is used to fasten two ends of a shoelace.

5. The fastener according to claim 1 wherein the fastener is used to fasten two hat strings.

6. The fastener according to claim 1 wherein the fastener is used to fasten two ends of a trousers belt.

* * * * *